United States Patent [19]

Schiff et al.

[11] 4,185,741

[45] Jan. 29, 1980

[54] SHIPPING CONTAINER AND BLANK THEREFOR

[75] Inventors: Robert A. Schiff, Jackson; John T. Holladay, Pinson, both of Tenn.

[73] Assignee: Packaging Corporation of America, Evanston, Ill.

[21] Appl. No.: 879,090

[22] Filed: Feb. 21, 1978

[51] Int. Cl.[2] ..... B65D 85/64

[52] U.S. Cl. ..... 206/326; 206/491

[58] Field of Search ..... 206/326, 491, 521; 229/38

[56] References Cited

U.S. PATENT DOCUMENTS

| | | | |
|---|---|---|---|
| 1,188,825 | 6/1916 | Potter | 206/326 |
| 2,313,362 | 3/1943 | Rous | 206/326 |
| 2,331,753 | 10/1943 | Wohlers | 206/326 |
| 2,346,003 | 4/1944 | Bishop | 206/326 |
| 2,832,525 | 4/1958 | Calvin | 206/326 |
| 3,978,982 | 9/1976 | Duncan | 206/491 |

FOREIGN PATENT DOCUMENTS

| | | | |
|---|---|---|---|
| 227603 | 3/1963 | Austria | 206/326 |

*Primary Examiner*—Herbert F. Ross

*Attorney, Agent, or Firm*—Neuman, Williams, Anderson & Olson

[57] ABSTRACT

A shipping, container formed from a single blank of foldable sheet material is provided for use in accommodating an upholstered arm chair or the like. The container includes a front panel, a back panel and a pair of side panels foldably connected to said front and back panels. The upper edge of each side panel includes front, intermediate, and back segments which coact to form a stepped configuration with the back segment being elevated with respect to the front segment. Foldably connected to the front and back segments of the upper edges of the side panels are pairs of first and second top closure flaps. A third top closure flap is foldably connected to the upper edge of the back panel and is adapted to overlie the second pair of top closure flaps. A fourth top closure flap is foldably connected to the upper edge of the front panel. The fourth top closure flap includes a first section, which is adapted to overlie the pair of first top closure flaps, and a second section foldably connected to the first section and spanning the distance between the intermediate segments of the side panel upper edges. Bottom closure flaps are foldably connected to the lower edges of the front, back and side panels and coact with one another to form a closed bottom.

3 Claims, 5 Drawing Figures

SHIPPING CONTAINER AND BLANK THEREFOR

BACKGROUND OF THE INVENTION

The packing of upholstered arm chairs and the like for shipping or storage has normally required an inordinate amount of time and labor. The container in which the furniture was disposed normally required numerous components and resulted in a container which was bulky and awkward to handle. Frequently in the past, such containers failed to provide adequate protection for the accommodated piece of furniture and in many instances necessitated the use of fasteners, such as staples or the like, which might cause snagging or tearing of the upholstry fabric. The unpacking of prior containers of this general type by the customers oftentimes was an awkward, time-consuming manipulation requiring special tools and a large area to facilitate the operation.

Furthermore, prior containers of this general type in addition to not providing the necessary structural strength, also did not protect the accommodated item from dirt, insects and the like.

SUMMARY OF THE INVENTION

Thus, it is an object of the invention to provide a shipping container for upholstered arm chairs and the like which is not beset with the aforenoted shortcomings associated with prior constructions.

It is a further object of the invention to provide a shipping container of the type described which is formed from a single blank of foldable sheet material.

It is a further object of the invention to provide a shipping container which does not require special tools or an inordinate amount of manual effort to set up, load and unload the container.

It is a still further object of the invention to provide a shipping container of the type described which permits a better and more efficient stacking pattern for shipping or storage.

It is a still further object of the invention to provide a blank for a shipping container of the type described which may be readily formed on conventional high-speed slitting, slotting and scoring equipment and results in a minimal amount of material waste.

It is a still further object of the invention to provide a shipping container of the type described which provides added protection for the accommodated item in certain critical areas.

Further and additional objects will appear from the description, accompanying drawings and appended claims.

In accordance with one embodiment of the invention a shipping container for an upholstered arm chair or the like is provided which is formed from a single blank of fiberboard material. The container includes front, back and side panels which are foldably connected to one another and coact to encompass an upholstered arm chair. Top closure flaps are connected to the upper edges of the panels and define a closed top having a stepped surface configuration with the back portion of the surface being elevated relative to the front portion. Foldably connected to the bottom edges of the panels are bottom closure flaps.

For a more complete understanding of the invention reference should be made to the drawings wherein.

DESCRIPTION

Figure 1:
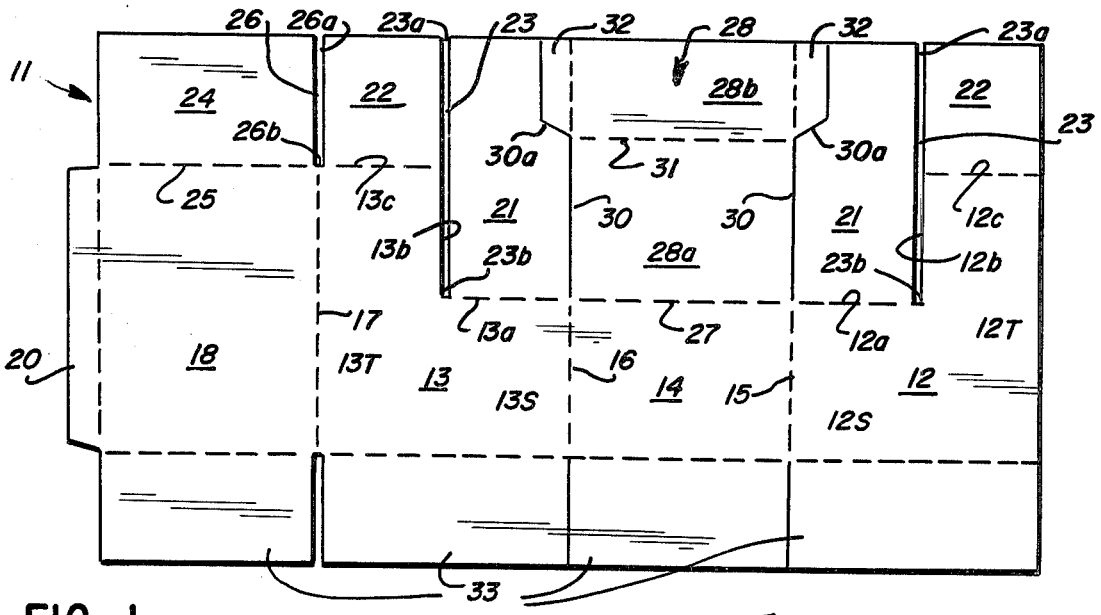
FIG. 1 is a plan view of a blank for one form of the improved shipping container.
Figure 5:
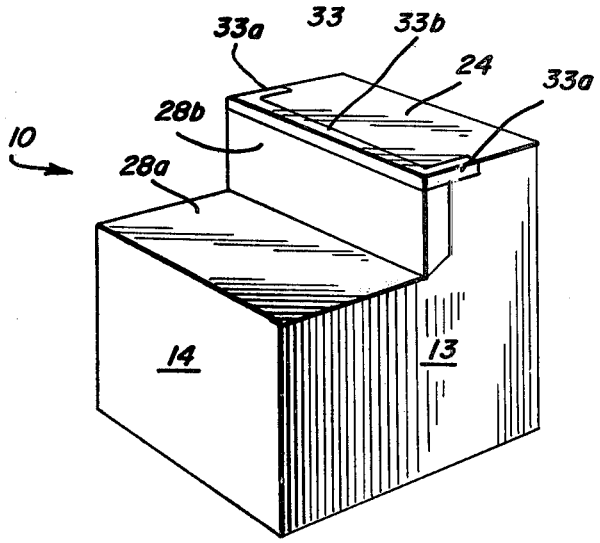
FIG. 5 is a perspective view of the container of FIG. 4 shown fully set up and ready for shipping or storage.

Referring now to the drawings and more particularly to FIG. 5, a preferred form of the improved shipping container 10 is shown which is particularly suitable for accommodating an upholstered arm chair or the like, not shown. Container 10 is formed from a single blank 11 of fiberboard material (e.g., double-faced corrugated board). The blank, as seen in FIG. 1, includes a pair of side panels 12, 13 of like configuration which are separated from one another by a front panel 14. Panels 12, 14 are connected to one another by a foldline 15 and panels 13 and 14 are connected to one another by foldline 16. Connected by foldline 17 to the opposite side of panel 13 is a back panel 18. To the outer edge of the back panel is foldably connected a conventional glue flap 20.

The upper edge or end of each side panel 12, 13 is formed into a front section **12*a*, 13*a*, an intermediate section 12*b*, 13*b*, and a back section 12*c*, 13*c*. The sections coact with one another so as to form a stepped edge configuration whereby the back sections 12*c*, 13*c* are elevated relative to the front sections 12*a*, 13*a* when the blank 11 is set up to form container 10. By reason of the stepped configuration each side panel has a tall portion 12T, 13T and a short portion 12S, 13S. The short portions 12S, 13S of the side panels are adjacent the front panel 14 and are connected thereto by foldlines 15, 16**, respectively.

Foldably connected to the front sections **12*a*, 13*a* of the upper edges of the side panels 12, 13 is a pair of first top closure flaps 21. In a similar manner, a pair of second top closure flaps 22 is connected to the back sections 12*c*, 13*c* of the side panel upper edges. The top closure flaps 21, 22 of each side panel 12, 13 are separated from one another by an elongated slot 23 which is aligned with the intermediate section 12*b*, 13*b* of the side panel upper edge. The upper open end 23*a* of each slot 23 terminates at the periphery of the blank and the lower end 23*b* of each slot terminates at the juncture of the front and intermediate segments 12*a*, 12*b* or 13*a*, 13*b*** of the side panel upper edge.

A third top closure flap 24 is connected by foldline 25 to the upper edge of back panel 18. Flap 24 is separated from the adjacent flap 22 by an elongated open end slot 26. The open end **26*a* of the slot is at the blank periphery. The closed end 26*b* of the slot is disposed at foldline 25**.

Connected by foldline 27 to the upper edge of front panel 14 is a fourth top closure flap 28. Flap 28 is separated from the pair of first top closure flaps 21 by a pair of elongated slits 30. Each slit 30 extends from an end of foldline 27 to the periphery of the blank. The fourth top closure flap 28 includes first and second section **28*a*, 28*b* connected to one another by a foldline 31 which is spaced from and substantially parallel to foldline 27. The spacing between foldlines 27, 31 is substantially equal to the length of the front segment 12*a*, 13*a*** of the side panel upper edge.

Foldably connected to opposite side edges of the second section 28b of top closure flap 28 are ears or glue flaps 32, the function of which will be described more fully hereinafter. The ears 32 are cut out of the top portions of the adjacent first top closure flaps 21 by the upper offset portions 30a of the slits 30, see FIG. 1.

Foldably connected to the bottom edges of panels 12, 13, 14 and 18 are bottom closure flaps 33 which coact to form a closed bottom when the blank is set up to form container 10.

Figure 2:
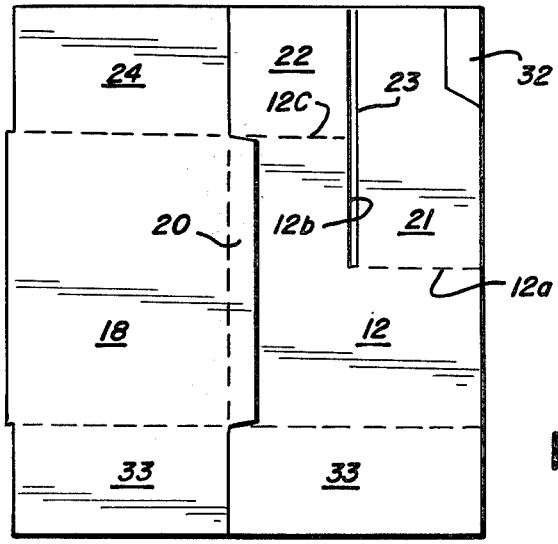
FIG. 2 is similar to FIG. 1 but showing the blank in an initial folded, collapsed condition.

In setting up the container, back panel 18, associated closure flaps 24, 33 and glue flap 20 are folded as a unit about foldline 17 so as to overlie side panel 13 and its associated closure flaps 21, 22 and 33. Side panel 12 and associated closure flaps 21, 22 and 33 are then folded as a unit about foldline 15 so as to overlie front panel 14 and its associated closure flaps 28 and 33. A peripheral segment of the tall portion 12T is adhesively secured to the glue flap 20, the latter having had an adhesive coating previously applied thereto. The blank in its initial folded or collapsed condition is shown in FIG. 2 and while in this state may be readily stored by or shipped to the furniture manufacturer.

Figure 3:
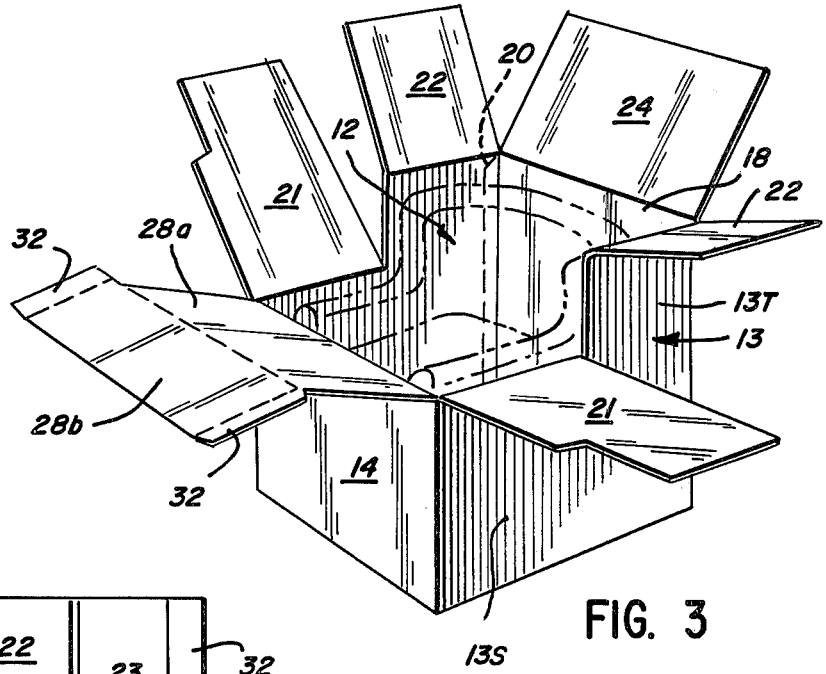
FIG. 3 is a perspective view of one form of the improved container set up for loading.

When the container is to be set up for loading, the panels 12, 13, 14 and 18 are squared up as seen in FIG. 3 and the bottom closure flaps 33 folded relative to one another and secured in an overlapping bottom-forming relation. The top closure flaps 21, 22, 24 and 28 are then folded outwardly a slight amount so that the open top of the container will be unobstructed for loading. The arm chair, shown in phantom lines in FIG. 3, be it upholstered or not, is then placed upright within the container so that the back of the chair is disposed adjacent to the back panel 18 of the container. Inner packing may be utilized as required.

Figure 4:
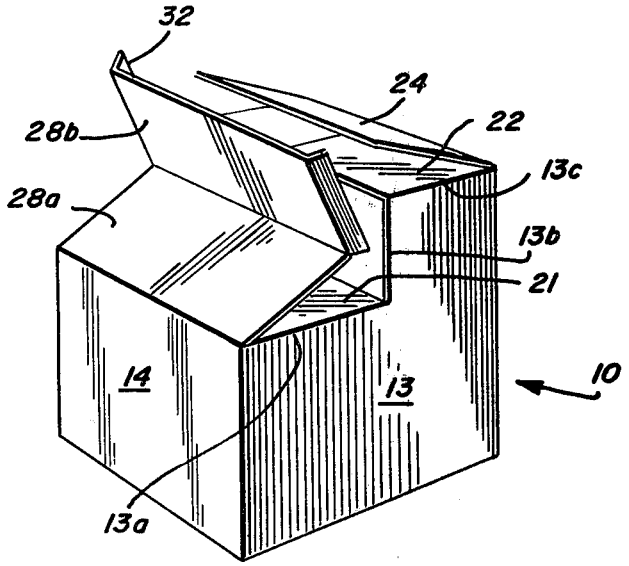
FIG. 4 is a fragmentary perspective view of the improved container showing how certain of the top closure flaps are folded relative to one another so as to close the container after it has been loaded.

Once the arm chair is in place, the first and second top closure flaps 21, 22 are folded inwardly towards one another so as to overlie respectively the arms and back of the accommodated chair. The flaps 21 are normally of such lengths that each substantially spans the distance between the squared up side panels 12, 13. The third top closure flap 24 is then folded so as to overlie the previously folded flaps 22. Flaps 22 may be adhesively secured to flap 24, if desired. Subsequent to flap 24 being folded into overlying relation with flaps 22, the fourth top closure flap 28 and associated ears 32 are folded as a unit about foldline 27 so that the first section 28a overlies previously folded flaps 21. Simultaneously with the folding of flap 28, the second section 28b thereof is folded about foldline 31 so as to assume a substantially right angle, upright position with respect to section 28a, see FIG. 4. The distance between foldlines 27, 31 is substantially the same as the length of the front segment 12a, 13a of the upper edge of each side panel 12, 13. In a similar manner the corresponding dimension of section 28b measured normal to and from foldline 31 to the outer periphery of the blank is substantially the same as the length of the intermediate segment 12b, 13b of the upper edge of each side panel 12, 13. In addition, the width of flap section 28b is such that it spans the distance between the intermediate segments 12b, 13b of the side panels. Flap section 28b remains in its upright position by means of the ears 32 which are folded so as to overlie and be adhesively secured to the exterior of the tall sections 12T, 13T of the side panels 12, 13. In addition to the adhesive securement of the ears 32 to the side panel, a strip of adhesive tape 33, see FIG. 5, is applied to the exterior of the container so that the ends 33a thereof overlie or straddle a portion of each corner formed between the folded top closure flap 24 and the tall portion 12T, 13T of each side panel. The center part 33b of the tape 33 overlies or straddles the corner formed between flap section 28b and closure flap 24. The tape 33 serves a dual function: (a) it assists in securing the flap 24 and flap section 28b in folded positions and (b) it seals the corner between flap 24 and flap section 28b against dirt and insect infestation.

The height and depth of the stepped configuration of the container top surface may vary from that shown and will depend upon the configuration of the accommodated arm chair. By reason of the top surface of the container having a stepped configuration, stacking of loaded containers may be facilitated and the space occupied by the stacked containers will be less than would normally be required.

It will be noted in FIG. 1 that the periphery of the blank 11 is substantially uniform and a minimal amount of material waste is generated when the blank is being formed. Furthermore, the shape of the blank enables the latter to be readily formed by a single pass through the slotting, slitting and scoring machine. Because the closure flaps and ears are preferably secured in place by adhesive and tape, upholstered furniture may be accommodated within the container without the danger of the upholstery fabric being snagged or torn.

While the improved container and blank have been described in relation to an upholstered arm chair, the invention is not intended to be limited thereto. Other types of furniture having stepped upper profiles may be accommodated in the container if desired. Furthermore, the foldlines connecting the top closure flaps to the front, side and back panels may comprise a plurality of closely spaced substantially parallel foldlines. The particular foldlines to be used in folding the closure flaps into overlapping closed relation will depend upon the heights of various portions of the accommodated article.

We claim:

1. A shipping container formed from a single substantially rectangularly shaped blank of foldable sheet material for accommodating an article having the upper portion thereof with a stepped profile, said container comprising a bottom for subtending and supporting the article; an upright back panel connected to said bottom and being positionable adjacent the back of the accommodated article; a pair of upright side panels foldably connected to opposite side edges of said back panel and extending angularly therefrom, said side panels being connected to said bottom and being positionable adjacent the sides of the accommodated article, the upper end of each side panel having front, intermediate and back edges connected to form a stepped configuration adapted to conform substantially to the accommodated article stepped profile, the back edge being elevated relative to said front edge, the lengths of said front and back edges combining to define substantially the depth of the container; an upright front panel connected to said bottom and having opposite side edges thereof foldably connected to said side panels and defining substantially the width of the container, said front panel being positionable adjacent the front of the accommodated article; a pair of first top closure flaps foldably connected at said front edges of the side panel upper ends and being adapted to overlie a first portion of the accommodated article; a pair of second top closure flaps foldably connected to the back edge of the side panel upper ends and being adapted to overlie a second portion of the accommodated article; a third top closure flap foldably connected to the upper edge of said back panel and terminating with a free edge and overlying the second top closure flaps; a fourth top closure flap foldably connected to the upper edge of said front panel, said fourth top closure flap including a first section overlying said first top closure flaps and a second section foldably connected to said first section and terminating with a free edge and spanning the distance between the intermediate edge of the side panel upper ends, and laterally extending ears foldably connected to opposite edges of said second section and secured to surface portions of said side panels adjacent the intermediate edge of said side panel upper ends.

2. The shipping container of claim 1 wherein the first and second top closure flaps substantially span the distance between said side panels and each laterally extending ear is substantially coextensive with the intermediate edge of the upper end of an adjacent side panel.

3. A substantially rectangular blank of foldable sheet material for use in forming a complete shipping container comprising a front panel; a first side panel disposed on one side of said front panel and foldably connected thereto; a second side panel of substantially the same configuration disposed on the opposite side of said front panel and foldably connected thereto, the foldline connections between said front panel and said side panels being in spaced substantially parallel relation; a back panel separated from said front panel by said second side panel and foldably connected to the latter, each side panel having a short section disposed adjacent to said front panel and foldably connected thereto and a contiguous tall section, the tall section of said second side panel being adjacent said back panel and foldably connected thereto; a pair of first top closure flaps foldably connected to corresponding edges of the short sections of said side panels; a pair of second top closure flaps foldably connected to corresponding edges of the tall sections of said side panels, the first and second top closure flaps connected to a side panel being separated from one another by a first elongated open end slot extending from the blank periphery to the folding connection between said first top closure flap and said short section, said slot being disposed substantially perpendicular to said folding connection; a third top closure flap foldably connected to said back panel and separated by a second elongated open end slot from the second top closure flap connected to the tall section of the second side panel; and a fourth top closure flap foldably connected to an edge of said front panel, said fourth top closure flap being disposed intermediate said first top closure flaps and separated therefrom by elongated slits, each slit extending from the blank periphery to the folding connection between the first top closure flap and the short section of the side panel, said fourth top closure flap including foldably connected first and second sections, said first section being disposed adjacent to said front panel and said second section being foldably connected to said first section and separated from said front panel by said first section, the folding connections between the second top closure flaps and said side panel tall sections being in spaced parallel relation with respect to the folding connection between the first and second sections of said fourth top closure flap; the second section of said fourth top closure flap being provided with a pair of foldable laterally extending ears, each ear extending into an adjacent first top closure flap and being separated therefrom by an offset portion of the slit separating the first top closure flap from the fourth top closure flap.

* * * * *

UNITED STATES PATENT AND TRADEMARK OFFICE

CERTIFICATE OF CORRECTION

PATENT NO. : 4,185,741

DATED : January 29, 1980

INVENTOR(S) : Robert Andrew Schiff and John Thomas Holladay

It is certified that error appears in the above–identified patent and that said Letters Patent are hereby corrected as shown below:

IN U.S. PATENT DOCUMENTS:

(Reference 2,832,525): "Calvin" should be -- Cavin --

Line 1, delete the comma "," after "shipping"

SPECIFICATION:

Column 2, line 63 - change "section" to -- sections --

Claim 1:

Column 4, line 68 - change "edge" to -- edges --

Column 5, line 11 - change "edge" to -- edges --

Column 5, line 15 - change "edge" to -- edges --

UNITED STATES PATENT AND TRADEMARK OFFICE

CERTIFICATE OF CORRECTION

PATENT NO. : 4,185,741

DATED : January 29, 1980

INVENTOR(S) : Robert Andrew Schiff and John Thomas Holladay

It is certified that error appears in the above—identified patent and that said Letters Patent is hereby corrected as shown below:

Column 5, line 12, insert after "ends,"

-- the lengths of said side edge of said front panel and said intermediate edge combining to define the height of said container, said free edge of said third top closure flap being in contacting relationship with said second section free edge to close said container; --

Signed and Sealed this

*Eighth* Day of *July 1980*

[SEAL]

*Attest:*

SIDNEY A. DIAMOND

*Attesting Officer*

*Commissioner of Patents and Trademarks*